US006073805A

United States Patent [19]

Gueret

[11] Patent Number: 6,073,805

[45] Date of Patent: Jun. 13, 2000

[54] ASSEMBLY FOR PACKAGING AND DISPENSING A LIQUID PRODUCT

[75] Inventor: Jean-Louis H. Gueret, Paris, France

[73] Assignee: L'Oreal, Paris, France

[21] Appl. No.: 09/256,304

[22] Filed: Feb. 24, 1999

[30] Foreign Application Priority Data

Mar. 27, 1998 [FR] France ..... 98 03831

[51] Int. Cl.[7] ..... B65D 35/28

[52] U.S. Cl. ..... 222/95; 222/105; 222/321.7; 222/321.9; 222/385

[58] Field of Search ..... 222/95, 105, 321.1, 222/321.7, 321.9, 383.1, 385

[56] References Cited

U.S. PATENT DOCUMENTS

| | | | |
|---|---|---|---|
| 3,920,164 | 11/1975 | Lindsoe | 222/385 |
| 4,008,830 | 2/1977 | Meshberg | 222/95 |
| 4,813,576 | 3/1989 | Greenebaum, II . | |
| 5,100,027 | 3/1992 | Gueret | 222/105 |
| 5,139,168 | 8/1992 | Gueret | 222/105 X |
| 5,147,073 | 9/1992 | Cater | 222/385 X |
| 5,292,003 | 3/1994 | Gueret | 222/95 |
| 5,388,727 | 2/1995 | Jouillat | 222/105 |
| 5,503,306 | 4/1996 | Knickerbocker | 222/321.1 |
| 5,509,584 | 4/1996 | Gueret | 222/321.7 |
| 5,630,531 | 5/1997 | Gaucher | 222/105 X |
| 5,845,819 | 12/1998 | De Pous | 222/385 X |

FOREIGN PATENT DOCUMENTS 0 486 355 A1 5/1992 European Pat. Off. .

*Primary Examiner*—Kenneth Bomberg
*Attorney, Agent, or Firm*—Oblon, Spivak, McClelland, Maier & Neustadt, P.C.

[57] ABSTRACT

Assembly for packaging and dispensing a product, particularly a liquid product, includes a closed reservoir (2) for the product, consisting of a variable-volume body, one end of which is closed by a rigid base (16) including a transverse bottom (20) traversed by an emerging collar (18) forming a single piece with the base; and a pump (26) arranged in the collar, in communication with the reservoir. The inner wall of the collar (18) includes fastening element **(18*d*) capable of permanently deforming a zone of the body (28) of the pump (26) in order to immobilize the pump (26)** in the collar.

16 Claims, 3 Drawing Sheets

ASSEMBLY FOR PACKAGING AND DISPENSING A LIQUID PRODUCT

BACKGROUND OF THE INVENTION

1. Field of the Invention

The present invention relates to an assembly for packaging and dispensing a product, particularly a liquid product and to its use for packaging and dispensing a cosmetic, pharmaceutical or dermopharmaceutical product. More particularly, the invention relates to a packaging and dispensing assembly of that type which comprises a variable-volume reservoir of the type with a pouch or follower plunger for the product, integral with a mounting base on which a manual pump, surmounted by a push button equipped with a dispensing orifice, is fastened.

2. Description of the Related Art

Generally speaking, manual pumps are crimped onto a flask or onto a neck located at the top part of a mounting base capping a product reservoir. Customarily, a pump of this tripe is delivered with a metallic crimping ring intended for fastening the pump onto the neck of the base. The crimping of this metallic ring onto the neck requires a free space around the neck so that crimping may be carried out. The result of this is that the crimping ring is substantially higher than the top part of the base, which increases the total height of the assembly and is unattractive. Moreover, an assembly which includes a pump perched on top is difficult to use. If the assembly is held at the reservoir, the length of the index finger intended for pressing on the push-button may be insufficient to allow easy maneuvering of the dispenser.

In order to provide a more compact dispenser which may be used more easily, the Applicant has already produced a product dispenser equipped with a base in the shape of a dish engaged in a container containing the reservoir. To avoid problems when crimping the pump onto the base, the pump is crimped onto a transfer component which is itself fastened onto the base. This type of dispenser is described in EP-A-0,486,355 and EP-A-0,628,355.

U.S. Pat. No. 5,388,727 describes a tube equipped with a dispensing head provided with a collar in which a dispensing pump is mounted by means of snap-fitting. The valve body and the inner wall of the collar are equipped with mounting elements capable of interacting with each other. This device requires a pump, the body of which has fastening elements extending radially outwards and which have to be specially designed. Moreover, a collar provided with a circular groove has to be shaped so as to complement the fastening elements of the pump body, which is difficult or uneconomical to achieve in practice. In addition, a fastening technique of this type may be inadequate in terms of the seal between the pump body and the collar.

SUMMARY OF THE INVENTION

It is an object of the present invention to simplify the mounting of the pump onto the base by eliminating the transfer component and thus to reduce manufacturing and fitting costs.

It is a further object of he invention to provide a dispensing assembly which does not require a supplementary sealing component between the pump and the support onto which it is fastened.

According to a first aspect of the invention, the above and other objects are achieved by an assembly for packaging and dispensing a product, particularly a liquid product, comprising a closed reservoir for the product, consisting of a variable-volume body, one end of which is closed by a rigid base including a transverse bottom traversed by an integral collar; and a pump arranged in the collar, in communication with the reservoir. The collar includes a fastening portion capable of permanently deforming a zone of the pump body in order to immobilize the pump in the collar.

A further feature of the invention consists in producing, with the aid of the fastening portion, a seal between the pump body and the inner wall of the collar. The product may be a cosmetic, pharmaceutical or dermopharmaceutical product.

According to an advantageous embodiment, the pump is immobilized in the collar by the radial deformation of the pump body with respect to the fastening portion. In this case, such radial deformation of the pump body is preferably achieved by an annular profile carried by the inner wall of the collar and located in the vicinity of one of the ends of the pump body, either at the top or at the bottom, so as not to interfere with the mobility of the valve rod and is thus the functioning of the pump.

The annular profile advantageously has substantially the shape of an angular edge or a rounded bead. According to one embodiment, a profile of this type is formed by the end of an inner frustoconical portion of the collar, the diameter of which preferably increases in the direction of insertion during mounting of the pump. In this case, the securing and/or sealing of the pump is achieved by the deformation of a zone of the pump body into which the profile more or less partially enters. To this end, when the base and thus the collar are produced, a thermoplastic material which is more rigid than the material constituting the pump body is preferably chosen. Obviously, during mounting of the pump, the edge may also undergo a deformation so as to make up for molding defects in the parts of the pump body which interact with this edge. Advantageously, for economic purposes, the pump used is a commercially available pump.

It is known that certain materials such as, for example, polypropylene and certain polyethylenes, may undergo permanent deformation, known as forming, when they are placed under stress. When the stress force is sufficiently high, this forming may be carried out cold. Thus, when a pump body of initially cylindrical shape is inserted into a collar whose inner wall has a slightly frustoconical portion, accompanied by appropriate gripping, the pump body deforms radially in order to adopt an outer shape which is also frustoconical, to complement the shape of the inner wall of the collar. In general, radial deformation of the pump body is of the order of a few hundredths of a millimeter.

Depending on the material selected for the production of the pump body, it may be formed so that permanent deformation arises only in the thickness of its wall, the internal geometry of the pump remaining unaffected. In this case the deformed zone of the pump body may be located at any axial level of the body. However, when forming gives rise to an internal reduction of the pump body, the deformation zone must advantageously be located either at the top end or at the bottom end of the pump body; internal deformation at such locations does not risk obstructing the movement of the movable parts of the pump, particularly the travel of the pump rod.

According to an advantageous embodiment, the transverse bottom of the base is connected to a peripheral cylindrical border extending at least partially on the side opposite the reservoir, the collar having a height which is substantially equal to or less than the height of the peripheral border of the bottom. This arrangement allows the push-button to be guided when it is actuated. If appropriate, this arrangement also makes it possible to camouflage part of the push button by positioning it low in the assembly.

Advantageously, substantially the entire body of the pump is housed in the collar. Such an arrangement makes it possible to construct an assembly which is particularly compact, which is advantageous from an aesthetic, packaging and storage standpoint.

According to a further, particularly preferred, embodiment, the fastening portions also act as a sealing element between the pump body and the collar.

According to a further embodiment, it may be advantageous to provide in the collar, sealing elements which are distinct from the fastening portions and are capable of interacting with complementary sealing elements carried by the pump body.

Advantageously, the assembly of the invention is also equipped with a push-button provided with a dispensing orifice and with a connection passage capable of placing the pump in communication with the dispensing orifice.

In order to mount the push-button as low as possible, the push-button may include an outer skirt capable of sliding inside or outside the peripheral border of the base. In this case, the outer skirt of the push-button and the cylindrical border of the base are concentric and located at a short radial distance from each other. The push-button may thus be guided when actuated.

According to a preferred embodiment, the reservoir is a deformable pouch made, for example, of a sheet made from a complex material, such as a multi-layer sheet composed of three layers: thermoplastic layer/metallic layer/thermoplastic layer. A pouch of this type is advantageously fastened onto a skirt carried by the base. When a deformable pouch is used, it may advantageously be placed in a rigid housing equipped with a venting hole. This housing is advantageously integral with the base.

According to a further possibility, the reservoir is formed by a rigid cylindrical envelope, of which the end opposite the base is closed by a follower plunger which is movable axially and is displaced from the bottom of the reservoir towards the pump in step with the emptying of the reservoir.

The assembly of the invention may, in particular, be used for packaging and dispensing a cosmetic product, particularly a hair-care, pharmaceutical or dermopharmaceutical product.

BRIEF DESCRIPTION OF THE DRAWINGS

In order to facilitate understanding of the present invention, a plurality of embodiments thereof shown in the appended drawings will be described by way of purely illustrative and non-limiting examples, wherein.

DETAILED DESCRIPTION OF THE PREFERRED EMBODIMENTS

Figure 1:
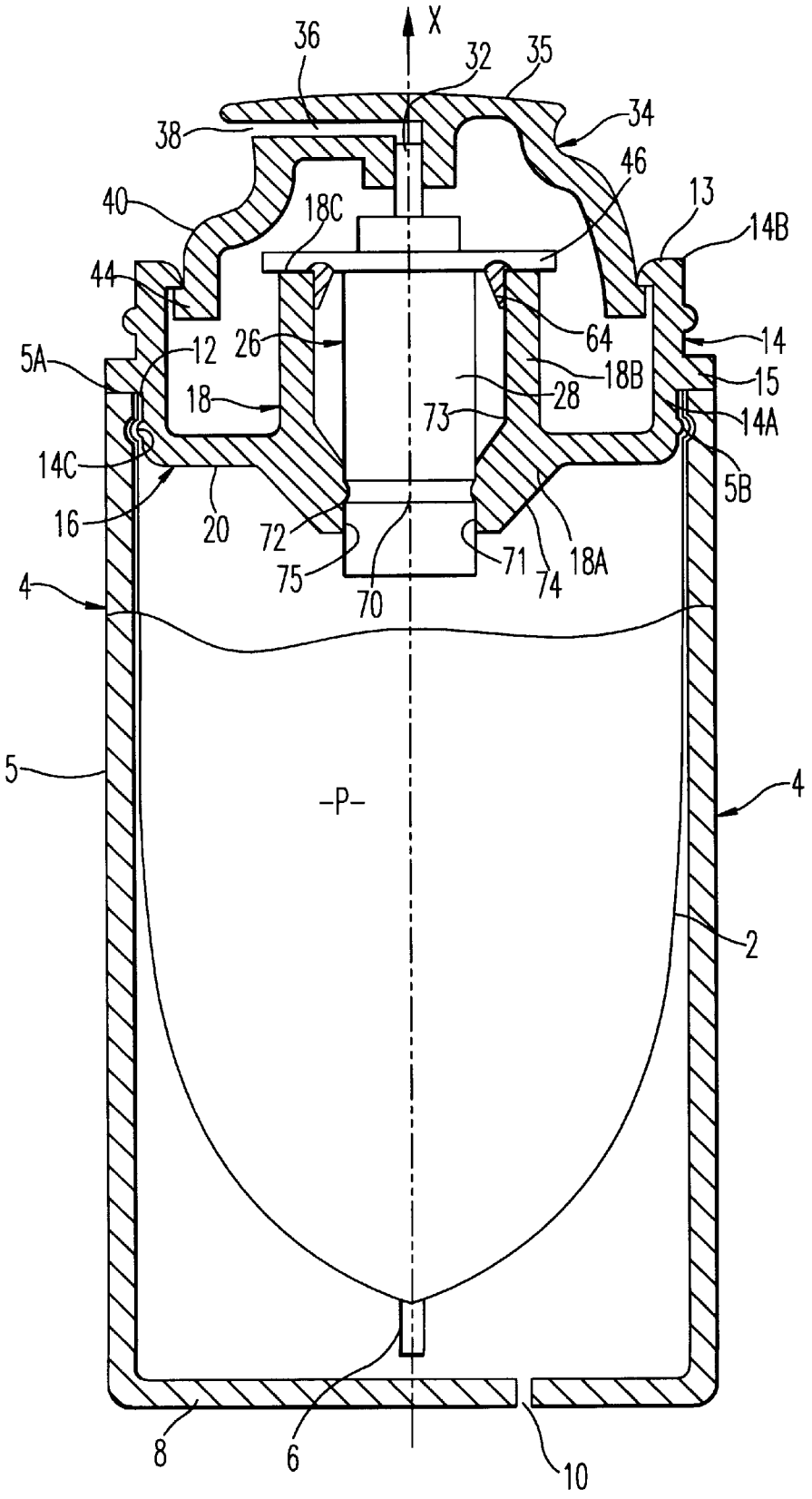
FIG. 1 is a view in axial section of a packaging and dispensing assembly according to a first embodiment of the invention.

FIG. 1 shows a packaging and dispensing assembly 1 according to a first embodiment of the invention. This assembly, of axis X, comprises a deformable reservoir 2 containing a liquid or viscous product such as a cream, a gel, a body milk or a lotion. This reservoir 2 is housed in an outer rigid housing 4. The reservoir 2 is in the form of a pouch and consists of a flexible plastic sheet, for example one made from polyethylene or of a complex formed by a metallic layer and at least one plastic layer. The bottom of the pouch 2 is closed by a weld line 6. In order to make it possible to achieve equilibrium of the internal pressure of the housing 4 during emptying of the pouch, the bottom 8 of the housing is provided with a venting opening 10. The housing 4 has a side wall 5 having an open end 5*a*.

The free upper border 12 of the pouch 2 is fastened by adhesive bonding, welding or any other appropriate way, onto a cylindrical skirt 14 formed on a base 16. The cylindrical skirt 14 is provided with an annular projection 15 bearing on the free end 5*a* of the housing wall 5. The cross section of the skirt 14, perpendicular to the axis X, may be circular, oval, rectangular, etc. The projection 15 thus separates the skirt 14 into a lower portion 14*a* and an upper portion 14*b* which ends in a shoulder 13 facing the axis X. The lower portion 14*a* is provided with a first bead 14*c* capable of interacting with a complementary groove 5*b* provided on the inner surface of the housing wall 5 in the vicinity of its free end 5*a*. By this arrangement, the free end 12 of the pouch 2 is pinched between the free end 5*a* of the housing wall 5 and the lower portion 14*a* of skirt 14 of the base 16.

The base 16 has the form of a dish provided with a transverse bottom 20 traversed by an integral cylindrical collar 18. This collar has a first portion 18*a* extending in the reservoir 2 and a second portion 18*b* facing towards the outside of the reservoir and having a free end 18*c*. The second portion 18*b* of the collar has a height which is substantially equal to the height of the skirt 14. The body 28 of a pump 26 is mounted in this second portion 18*b*. The pump 26 includes an actuating and dispensing rod 32, the emerging end of which is engaged in a push-button 34. The pump also includes a plate 46 of greater diameter than the pump body 28, located on the top part of the pump and in contact with the free end 18*c* of the collar 18. A removable protective cap (not shown) may be provided in order to protect the push-button 34 from any accidental actuation.

The body 28 of the pump 26 entirely traverses the collar 18. The portion 18*a* facing the reservoir is shaped as the frustum of a cone, the free end of which forms the smaller base 74 of the frustum of a cone. The inner surface 73 of the frustoconical portion serves to center the pump when the latter is mounted in the collar 18. The terminal part 74 of the collar 18 is provided with a cylindrical passage 75, the internal diameter of which corresponds substantially to the diameter of the body of the pump 26. This passage 75 is provided with an inner annular bead 72 capable of creating, by forming, a deformation zone 70 on the pump body 28, thereby fastening the pump body in the base.

Such forming is simple to produce by using for the base 16 a rigid material such as is customarily found amongst certain types of polyethylenes or polypropylenes in combination with a pump body 28 produced from a less rigid material than the material of the base 16.

When mounting the pump in the collar 18, the pump body 28 is inserted axially into this collar, the sloping surface 73 serving to guide and to center the pump. When the annular bead 72 abuts the lower end of the pump body, temporary radial deformation of the bottom portion of the pump body is caused by the application of a suitable axial force on the plate 46 of the pump. At the end of travel, the deformation zone 70 is permanently formed. The pump body is thereby reliably fastened in the collar 18. Moreover, sufficient sealing is obtained when a reduced pressure is established inside the reservoir 2 after a metered amount of product has been dispensed.

Moreover, the pump 28 according to the embodiment includes an angular lip 64 extending from the plate 46 in the direction of the reservoir 2. The sealing lip 64 bears against the inner wall of the end 18*c* of the collar 18 makes it possible to complete the seal of the pump mounting. This supplementary sealing means makes it possible to satisfy the extreme conditions of reduced pressure which may prevail inside the reservoir 2.

The push-button 34 has an upper surface 35 constituting a bearing zone on which the user presses in order to actuate the pump 26 to dispense a metered amount of product. A dispensing channel 36 connects the pump rod 32 to a dispensing orifice 38. The push-button has a body 40 with the general shape of a dome, the base of which includes an outwardly projecting portion 44, the external diameter of which is slightly smaller than the internal diameter of the peripheral skirt 14. The push-button 34 is thereby suitably guided axially in the skirt 14 when the pump is actuated.

This embodiment can be manufactured at a particularly attractive price. Thus, it is possible to provide a reservoir surmounted by a dispensing head and including an "integral" push-button which is positioned particularly low. A packaging assembly of this type may be produced by simple mounting.

FIGS. 2 to 5 illustrate further embodiments of the invention, In these Figures, a identical parts or parts which have a function similar to parts in the embodiment of FIG. 1 bear the same reference numbers. They will be described further only in part.

Figure 2:
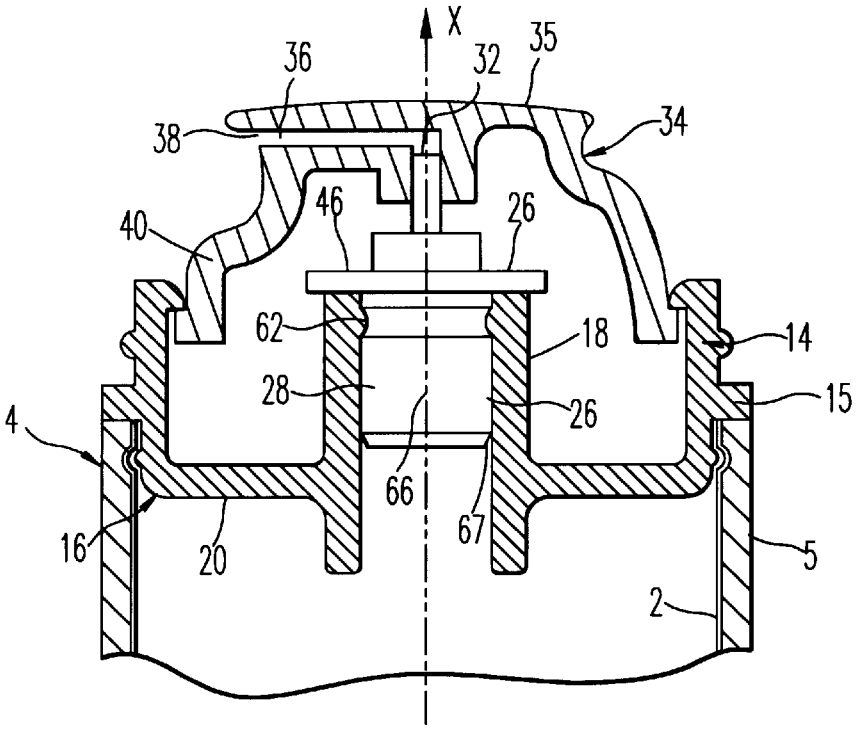
FIGS. 2 to 5 show partial views in longitudinal section of a packaging and dispensing assembly according to further embodiments of the invention.

As illustrated in FIG. 2, a pump 26 has a cylindrical body 28 is mounted forcibly in the collar 18. In order to fasten the pump, the collar includes a bead 62 of small radial thickness, in practice of the order of a few hundredths of a millimeter, located in the top part of the collar. When the pump is forcibly mounted in the collar 18, by pressing axially to deform the material constituting the pump body 28, an annular groove 66 of shallow depth is created in the outer wall of the pump. This groove both fastens the pump and seals the assembly thus produced. To facilitate insertion of the pump into the collar, the lower end of the pump is provided with a chamfer 67.

According to this embodiment, the body of the pump is produced from polyethylene. The base 16 and thus the collar are produced from polypropylene, the rigidity of which is greater than the rigidity of the polyethylene constituting the pump body. During the operation of mounting the pump, while passing the bead 62 the lower part of the pump body is deformed radially inwards so as permanently to form the zone 66 when mounting is complete.

Figure 3:
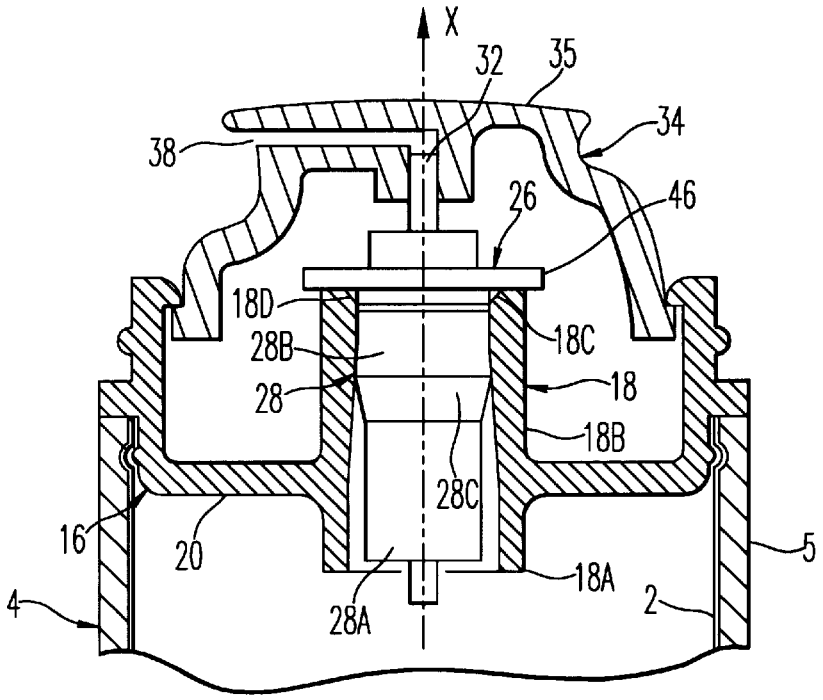

FIG. 3 shows a pump 26 with a body 28 in two portions: a first cylindrical portion 28*b* forming the upper part of the body; a second portion 28*a* forming the bottom part of the body and having a diameter which is smaller than the diameter of the upper portion 28*b;* a transition zone 28*c* located between the first and second portions 28*a* and 28*b* having a conicity which is inverse to the conicity of the first portion 28*b*. The pump body is inserted into a collar 18 forming part of a base 16 and whose inner wall is of slightly conical shape. The free end 18*c* of the collar includes an inner chamfer to facilitate mounting of the pump 26 in the collar 18. A zone 18*d* of smaller diameter is thus formed in the vicinity of the chamfer 28*c* capable of forming the portion 18*b* of the pump body, which makes it possible to completely seal the pump in the base.

In order to mount the pump, the transition zone 28*c* is partially engaged in the chamfered end 18*c*. When a suitable axial force is exerted on the plate 46 of the pump, the pump body undergoes a temporary peripheral deformation which is sufficient to allow the portion 28*b* to pass. In the final mounting position the zone 18*d,* made from a material more rigid than the material of the pump body, for example polypropylene, deforms the portion 28*b* of the pump body so that this portion adopts the shape of the inner wall of the collar. In general, this gives rise to a deformation of the pump body over a radial depth of a few hundredths of a millimeter. It should be noted that forming, at the location where it is achieved, does not give cause a malfunction of the pump. Forming is achieved in a zone of the pump body where no blockage of the movable components of the pump can take place.

Figure 4:
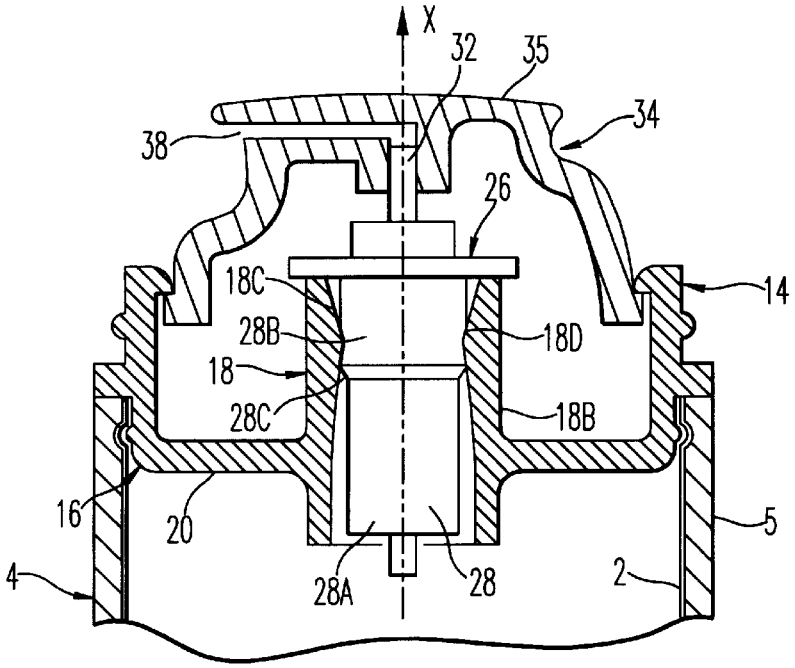

The embodiment shown in FIG. 4 is similar to that of FIG. 3 except that the body 28 of the pump is cylindrical. A zone 18*d* of smaller diameter, forming an annular edge located in the vicinity of a chamfer 18*c* of the free end of the collar 18 both secures and seals the pump in the collar by due to the forming of the body 28. This pump is mounted in a manner similar to the mounting of the pump in FIG. 3.

Figure 5:
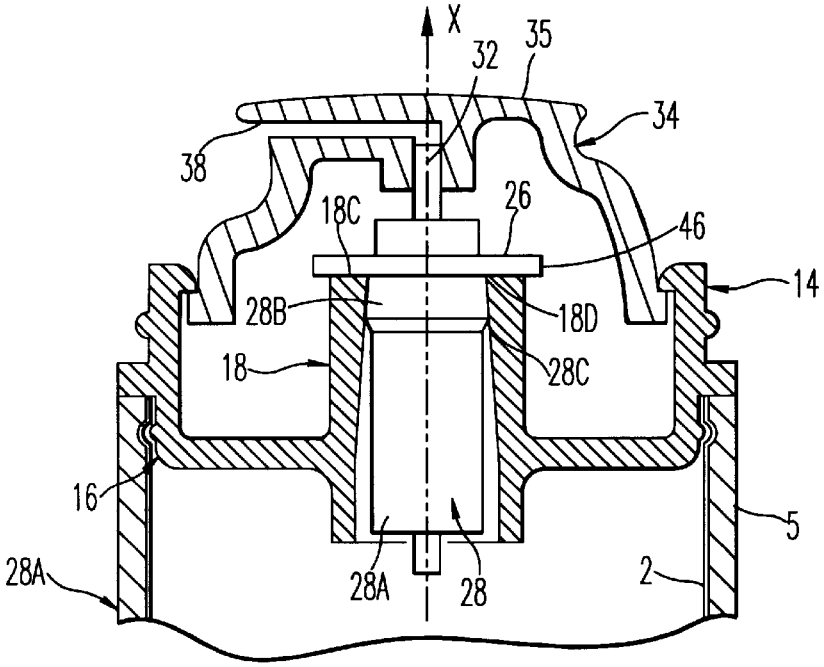

FIG. 5 shows a mounting method similar to the mounting method illustrated in FIG. 3, except that the free end of the collar 18 has no chamfer but does have an angular annular edge 18*d*. The collar 18 has a slightly conical upper portion opening in the direction of the reservoir 2. By virtue of the conicity of the collar compared with the cylindrical portion 28*b* of the pump body, it is possible to secure the pump by the portion 28*b* of the pump body being formed by the inner wall of the collar. The portion 28*b,* when mounting is complete, thus has a frustoconical shape which complements the conicity of the inner wall of the collar. The seal between the pump and the collar is obtained by the upper end of the pump body being formed by the edge 18*d*.

To mount this pump, the lower portion of the pump body is inserted into the collar 18, the frustoconical portion 28*c* resting on the free end 18*c* of the collar. By exerting a suitable axial thrust on the plate 46 the pump body is temporarily deformed, which allows the portion 28*b* to pass. After the pump has been positioned, the annular edge 18*d* creates, in the vicinity of the plate 46, by virtue of permanent forming, an annular groove in the pump body whose depth is a few hundredths of a millimeter. The pump is thus fastened in the collar in a leaktight manner.

In the above detailed description, reference has been made to particular embodiments of the invention. Obviously, variations may be made thereto without departing from the spirit of the invention as claimed below.

I claim:

1. An assembly for packaging and dispensing a product, comprising:

a closed reservoir for the product, comprised of a variable-volume body;

a rigid base closing one end of said reservoir, said base including a transverse bottom traversed by an integral collar; and a pump arranged in the collar and in communication with the reservoir.

wherein an inner wall of the said collar includes fastening portion capable of permanently deforming a zone of the body of the pump in order to immobilize the pump in the collar.

2. The assembly according to claim 1, wherein the fastening portion cooperates with a radial deformation of the pump body.

3. The assembly according to claim 2, wherein the radial deformation of the pump body comprises an annular profile located adjacent one end of said pump body so as not to interfere with a pumping operation.

4. The assembly according to claim 3, wherein said fastening portion comprises an annular bead provided on an inner wall of the collar, said annular bead capable of radially forming the annular profile.

5. The assembly according to claim 1, further comprising a push-button having a dispensing orifice and with a passage communicating the pump with the dispensing orifice.

6. The assembly according to claim 3, wherein the profile is an edge formed on an end of a frustoconical internal portion of the collar.

7. The assembly according to claim 6, wherein the frustoconical portion has a section which enlarges in the direction of the reservoir.

8. The assembly according to claim 5, wherein the transverse bottom is connected to a peripheral cylindrical border extending away from the reservoir, the collar having a height which is no greater than a height of the peripheral border.

9. The assembly according to claim 1, wherein the pump body is housed entirely in said collar.

10. The assembly according to claim 1, wherein the radial deformation of the pump body provides a pump-mounting seal.

11. The assembly according to claim 10, wherein the pump includes an additional seal separate from the radial deformation.

12. The assembly according to claim 8, wherein the push-button includes an outer skirt capable of sliding inside the peripheral border.

13. The assembly according to claim 1, wherein the reservoir is a deformable pouch.

14. The assembly according to claim 1, wherein the reservoir is formed by a rigid cylindrical housing, an end of which opposite the base is closed by a follower plunger.

15. The assembly according to claim 13, wherein the pouch is enclosed by a rigid housing provided with a venting orifice, the housing being fastened onto the base.

16. The assembly according to claim 1, holding a cosmetic product.

* * * * *